United States Patent [19]

Watanabe et al.

[11] Patent Number: 4,546,222

[45] Date of Patent: Oct. 8, 1985

[54] VACUUM SWITCH AND METHOD OF MANUFACTURING THE SAME

[75] Inventors: Ryuji Watanabe, Ibaraki; Akira Wada, Hitachi; Hisashi Ando, Hitachi; Seiki Shimizu, Hitachi; Yukio Kurosawa, Hitachi; Kiyoji Iwashita, Hitachi, all of Japan

[73] Assignee: Hitachi, Ltd., Tokyo, Japan

[21] Appl. No.: 584,903

[22] Filed: Feb. 29, 1984

[30] Foreign Application Priority Data

Mar. 4, 1983 [JP] Japan ..... 58-36452

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,957,453 | 5/1976 | Hassler et al. | 200/144 B X |
| 4,323,590 | 4/1982 | Lipperts | 200/144 B |
| 4,453,054 | 6/1984 | Peche et al. | 200/144 B |

*Primary Examiner*—Robert S. Macon

*Attorney, Agent, or Firm*—Antonelli, Terry & Wands

[57] ABSTRACT

Disclosed is a vacuum switch having a container and a pair of contact electrodes, and a method of manufacturing the same, in which at least one of the contact electrodes is constituted by a member made up of a skeleton containing cobalt as its principal component with pores into which a copper alloy containing copper as its principal component, silver, and a low melting point and high vapor pressure element having substantially no or very low solid-solubility with respect to the copper at a room temperature is impregnated.

25 Claims, 7 Drawing Figures

VACUUM SWITCH AND METHOD OF MANUFACTURING THE SAME

The present invention relates to a vacuum switch, and more particularly to an electrode material having a high withstand-voltage characteristic and a non-welding characteristic when used for a vacuum switch, and a method of manufacturing the same.

Conventionally, as the electrical and physical characteristics to be provided in an electrode for a vacuum switch, the following have been mentioned:

(1) The withstand-voltage characteristic is high;
(2) The non-welding characteristic is excellent;
(3) The large-current break-off capability is large;
(4) Chopping current seldom occurs;
(5) The amount of gas exhaust is small; etc.

Particularly, the characteristics (1) to (3) are very important factors to increase the capacity of the vacuum circuit breaker.

Conventionally, various Cu-base alloys have been used as a material for the electrode mentioned above. In order to improve the withstand-voltage characteristic of the above-mentioned characteristic (1), Cu-base alloys containing Fe, Co, or the like are typical ones. Further, in order to improve the non-welding characteristic, alloys containing a very small amount of low melting point and high vapor pressure elements, which have very low solid-solubility with Cu, such as Bi, Pb, or the like, have been practically used, and alloys of Cu-Co-Bi, Cu-Co-Pb are well known. Furthermore, recently, as the capacity of various power station equipments is made larger, the demand for the technique to break off a large current at a very high voltage has become greater. With an electrode of such a Cu-base alloy as mentioned above, however, it is very difficult to break off a large current, such as 40~100 kA, at a high voltage of 10 kV or more. This is because that the Cu-base alloy has a limit in the above-mentioned withstand-voltage characteristic as well as a problem in the non-welding characteristic.

Recently, vacuum switch electrodes made of a material of composite metal, other than the above-mentioned Cu-base alloy, have been disclosed in many patents. For example, U.S. Pat. No. 3,957,453 entitled "Sintered Metal Powder Electric Contact Material" and issued May 18, 1976, teaches a composite metal constituted such that Cu, Ag, or the like is impregnated into a sintered metal body having a melting point of 1600° C. or more. Since this composite metal is constituted such that, for example, Cu or Cu-alloy is infiltrated into a skeleton which is hard and brittle as its property, such as a Cr-sintered body, the electrode is excellent in non-welding characteristic so that the contact portions thereof can be easily separated from each other even after breaking-off of a large short-circuit current. In this point, the above-mentioned composite metal may be a material for breaking a large current. This material, however, has a drawback that desired break-off performance can be hardly obtained when a large current is broken off at a high tension. Generally, high melting point metal, such as W, Ta, Mo, has a high thermion emissivity and therefore the withstand-voltage between electrodes of such metal is low. Further, an active element such as Cr, Zr, Ti, or the like, has a tendency to evaporate under a high temperature in a vacuum and therefore the withstand-voltage characteristic across electrodes of such a material is not so good.

In contrast to such conventional materials as described above, there have been developed improved composite metals constituted such that Ag or an Ag-alloy is impregnated into a sintered body of Fe-group element, as a new material to overcome the dificiency of the conventional materials, and the electrode made of such composite metal is disclosed Japanese Patent Application Laid-open No. 9019/82 (corresponding to U.S. patent application Ser. No. 274,679 entitled "Vacuum Circuit Breaker" and filed June 17, 1981). This electrode is made of a composite metal constituted such that Ag, Ag-Te alloy, Ag-Se alloy, or the like, is impregnated at a vacuum into pores of a skeleton constituted by an Fe-group element, such as Co, having a high withstand-voltage characteristic, so that the chopping current thereof is very small and it has a very good break-off performance. It has been found, however, that there is a difficulty in application of this electrode structure to a vacuum switch of a very high voltage class because this electrode material contains, as its principal component, Ag having a low withstand-voltage characteristic. To cope with the prior art drawback as discussed above, it is required to develop a new large-capacity electrode structure which is high in withstand-voltage characteristic as well as in large-current break-off capability, which is excellent in non-welding characteristic, and, preferably, which is provided with a low surge property.

An object of the present invention is to provide a vacuum switch having an electrode structure which is excellent in withstand-voltage characteristic as well as in non-welding characteristic and which has a large-current break-off performance, and a method of manufacturing the same.

According to an aspect of the present invention, a vacuum switch having a vacuum container and a pair of contact electrodes disposed in the vacuum container is arranged such that at least one of the electrodes is constituted by a member which is constituted such that a Cu-base alloy containing Ag and an element having a low melting point, a high vapor pressure and substantially no or very low solid-solubility with respect to Cu at room temperature is impregnated into pores of a porous body containing Co as a principal component thereof.

The inventors prepared a skeleton made of Co powder, which has a large current conductivity, an excellent withstand-voltage characteristic, and a large-current break-off capability among Fe-group elements, and impregnated various conductive metallic materials into pores of the thus prepared skeleton. As the conductive metal materials, Cu and various Cu-alloys were examined. The inventors found that it was very difficult to simply make pure Cu impregnate into the Co skeleton because the difference in melting point between the Co skeleton and the pure Cu was so small that the Co skeleton was partially melted. That is, as soon as the molten Cu impregnated into the pores of the Co skeleton, resolution and erosion progressed therebetween so that the skeleton could not maintain its original form. Accordingly, the inventors examined various impregnating materials to be impregnated into the above-mentioned skeleton. Impregnating materials of various Cu-alloys were mainly examined since Ag and Ag-alloys were not suitable in view of the withstand-voltage characteristic while they were excellent in low surge property. As the additive elements, those which could lower the melting point of Cu but could not abnormally deteriorate the inner pressure in the tube of the vacuum switch were selected. As such elements, Al, Ag, La, Mg, Mn, Ni, Si, etc., were examined. Various Cu-alloys containing such elements were melted in a vacuum to prepare a molten bath of the same and the Co skeleton was immersed in the molten bath so that the Cu-alloy was impregnated into the Co skeleton. As the result of experiments, it was found that the material constituted such that a Cu-Ag alloy was impregnated into the Co skeleton was excellent because it had a high withstand-voltage characteristic and a good large-current break-off performance, and that the material had a current conductivity of 25 IACS (International Annealed Copper Standard) % or more so that the rated conduction current could be set to a large value. To form the Co skeleton for making the composite metal material of Co-(Cu-Ag)-alloy, it is easy when the porosity of the Co skeleton is selected to 10~60 volume % (that is the impregnated amount of Cu-Ag alloy is 10~60 wt. %) while it becomes difficult if the porosity exceeds 60 vol. %. Preferably, the porosity is selected to 30~60 vol. %. Although the impregnating property is improved if the compounding quantity of Ag contained in the Cu-Ag impregnant material is 5 wt. % or more relative to Cu, the impregnating property is not sufficient. Accordingly, it is preferable to select to 10 wt. % or more and more preferable to select to 50 wt. % in view of withstand-voltage characteristic. It was found that the Cu-Ag impregnant material could easily be impregnated into the Co skeleton and various kinds of electrical properties could be satisfied. Particularly, the yield of products was good when the compounding quantity of Ag was 15 wt. % or more, preferably 15~20 wt. % (at best 17 wt. %) because of the high withstand-voltage characteristic at that time. When the quantity of Ag was 15 wt. %, the yield was somewhat lowered, while 20 wt. % of Ag was too much. If the quantity of Ag exceeds 50 wt. %, the withstand-voltage characteristic was somewhat lowered. It is preferable to select the quantity of Ag to 2~20 wt. %, particularly to 4~12 wt. %, relative to the whole contact electrode. It is preferable that the skeleton containing Co as its principal component is constituted substantially by Co.

Further, according to the present invention, one element selected from the groups of Bi, Pb, Tl, Te and Se, which has substantially no or very low solid-solubility relative to Cu is added to the material of Co-(Cu-Ag) impregnating alloy, thereby providing excellent non-welding characteristic. The element such as Bi, Pb, or the like may be added when the molten Cu-Ag alloy is produced. When the content of the element such as Bi, Pb, or the like, is selected to be a more than the solid-solution limit of Cu relative to the Cu-Ag impregnating material, and 3 wt. % at maximum, the impregnating material shows excellent non-welding characteristic. When the content exceeds this maximum value, the withstand-voltage characteristic is lowered to the level of the conventional one. Preferably, the content of Bi, Pb, or the like, is selected at a very small amount of 0.1~1.0 wt. %. Particularly, relative to the whole electrode, it is preferable to select the content of Bi, Pb, or the like to 0.05~1.0 wt. %, and more preferably to 0.05~0.3 wt. %. The thus constituted material is not only excellent in withstand-voltage characteristic but also provided with a good large-current break-off performance and a good non-welding characteristic. It has been found that the material according to the present invention shows a low chopping current property of 3~6 A and provides a low surge property, while in the conventional electrode of Cu with or without containing 3 wt. % or less Bi, Pb, the chopping current takes a large value of about 8~16 A in breaking-off of a small current. Among the elements as mentioned above, Bi, Pb, Te and Se particularly show an excellent effect in non-welding characteristic, and the most preferable one of them is Bi. Particularly, it is preferable to add Bi of 0.05~0.3 wt. %. The material according to the present invention can be applied not only to the contact electrode, but also to the whole of the electrode structure. It is preferable, however, to apply the material according to the present invention only to the contact electrode.

According to another aspect of the present invention, the vacuum switch having a vacuum container and a pair of electrode structures disposed in the container is arranged such that the electrode structures respectively include contact electrodes, arc driving electrodes respectively supporting the corresponding contact electrodes, and coil electrodes respectively supporting the corresponding arc driving electrodes, the arc driving electrodes and the coil electrodes being arranged such that a parallel magnetic field is generated at a gap between the contact electrodes, and in that each of the contact electrodes is constituted by a skeleton containing cobalt as it principal component with air gaps thereof into which a copper alloy containing copper as its principal component, silver, and a low melting point and high vapor pressure element having substantially no or very low solid-solubility relative to the copper at a room temperature is impregnated.

In the arc driving electrode, a plurality of grooves are equidistantlly and bisymmetrically formed so that eddy currents can be suppressed. The arc driving electrode is formed such that arcs are generated therefrom at a voltage lower than that of the contact electrode. The parallel magnetic field is induced at the air gap between the respective contact electrodes such that arcs are generated from each arc driving electrode as well as each contact electrode upon breaking-off of a current, while the current is conducted through the respective contact electrodes. The parallel magnetic field can be obtained by the grooves formed in each arc driving electrode and the shape of each coil electrode. It is preferable to make up each arc driving electrode out of a solidified molten alloy containing Co of 10~30 wt. %, Ag of 10% or less, and Cu occupying substantially the remainder portion.

Each coil electrode is constituted by an annular ring portion, an arm portion passing through the axis center portion of circle of the ring portion, a connection portion provided with protrusions for connecting the coil electrode to the arc driving electrode and it is preferable to make up the coil electrode out of copper. Thus, currents flowing into the coil electrode pass in the opposite directions at the left and right sides of the coil electrode so as to induce a parallel magnetic field. Further, it is preferable to form the axis center portion of the arm portion into a ring-like shape.

In the vacuum switch according to the present invention, used are electrodes constituted by metal members in which the chopping current at 10 A is 6 A or less at maximum and 4.5 A or less on average, in which the average withstand-voltage at 2.5 mm gap is 55 kV or more, and in which the break-off current with a spherical surface of 20 mm diameter and 10 mm radius is 9 kV or more. The break-off current by thus arranged electrodes according to the present invention is 130% or more relative to the electrodes constituted by a solidified molten alloy containing Cu and 1.0 wt. % Pb. As the metal material, it is preferable to use an alloy constituted such that molten metal is impregnated into pores of a metal skeleton.

According to a further aspect of the present invention, the method of manufacturing a vacuum switch having a container and a pair of electrodes is featured in that it comprises the steps of:

(1) forming metal powder containing cobalt as its principal component into a porous skeleton having pores;

(2) immersing the skeleton in a molten bath of Cu-alloy containing Cu as its principal component, silver, and an element having low melting point, high vapor pressure and substantially no or very low solid-solubility with respect to Cu at a room temperature; and (3) shaping the skeleton in which the Cu alloy has been impregnated into a predetermined shape and disposing the shaped skeleton at the electrodes.

The method according to the present invention may comprises the steps of heat-processing a skeleton containing cobalt as its principal component in a vacuum to discharge gases contained in the skeleton out of the skeleton, and immersing the skeleton in the above-mentioned molten bath of copper alloy so as to cause the copper alloy to impregnate into the skeleton. It is preferable to use the electrodes according to the present invention with the copper alloy impregnated in the skeleton.

The skeleton containing cobalt as its principal component may be manufactured by such a manner that the mechanically ground metal powder is charged into a container, and subjected to pressure-forming or vibrations to make the particles of the powder so as to be densified in a form of the container without applying pressure-forming and then sintering the powder to provide the skeleton. The porosity of the skeleton is preferably set to 10~60 vol. %, whereby the content of the impregnated copper alloy becomes 10~60 wt. %. The sintering temperature may preferably be selected to 900°~1000° C.

The best way to perform the impregnation of copper alloy is to use an alloy which is obtained by solidified molten copper alloy containing desired components in advance of the step of impregnation. Generally, it is difficult to alloy a low melting point and high vapor pressure element with copper-silver alloy when the latter is solidified from molten state and it is preferable to make a mother alloy of copper-silver-element having low melting point and high vapour pressure. For the impregnation, the temperature of the molten bath and the time of immersion are the important factors. It is preferable to control the content of cobalt impregnated into the impregnant alloy from the skeleton to be 5 wt. % or less, and more preferably to be 3 wt. % or less.

It is desirable to sufficiently discharge gases out of the skeleton because the gases contained in the electrodes may come out of the electrodes to raise the pressure of vacuum in the vacuum tube to deteriorate the break-off performance.

Preferably, the skeleton containing cobalt as its principal component is made essentially of cobalt. Cobalt has a large current conductivity of IACS 25~30% and has the most largest current break-off performance among metals. It is preferable to select the cobalt powder to have a particle diameter of 30~70 μm, and that, more preferably, the particles of the powder have substantially equal diameter of 40~50 μm. It is preferable that the diameter of the cobalt particle is 10~50 μm after the impregnation of copper alloy. By using the cobalt powder of such a particle size, it is possible to obtain a skeleton to which the copper alloy can be easily impregnated and which is high in withstand-voltage and good in current break-off performance.

The present invention will be apparent from the following detailed description taken in conjunction with the accompanying drawings, in which.

EXAMPLE 1

Figure 2:
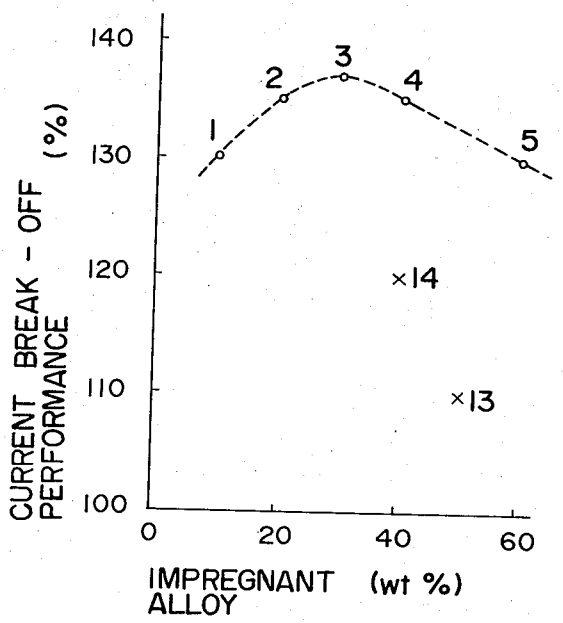
FIG. 2 is a diagram showing the relation between the current break-off performance and the amount of impregnation of the impregnant alloy.

The Co skeleton which serves as a matrix was formed such that mechanically ground Co powder of −250~+325 mesh was annealed in an atmosphere of hydrogen at a temperature of 500°~700° C., and then provisionally shaped to provide predetermined porosity by using a hydraulic press. The shaped body was then provisionally sintered in an atmosphere of hydrogen at a temperature of 900°~1000° C. After sintering, gas-discharge was performed in a vacuum at a high temperature of 1000°~1100° C. so as to completely discharge the gasses. The impregnating alloy containing Cu, Ag and a low melting point and high vapor pressure element was produced in the following manner. Oxygen free copper (OFC) and 99.99 wt. % pure Ag shot were set in a carbon crucible having an inner diameter of 60 mm and melted by high frequency induction in a vacuum of $1\times10^{-5}\sim5\times10^{-5}$ mm Hg. After confirmation of the molten state of Cu-Ag, a high-purity Ar gas was filled in the crucible at one atmospheric pressure and the low melting point and high vapor pressure element was added with a predetermined quantity. In this manner, the vapor loss of the element such as Bi can be prevented and a gas-free impregnating alloy can be obtained.

The method of obtaining an electrode by using the above-mentioned Co skeleton and the impregnating alloy will be described hereunder. The Co skeleton is put on a holder of carbon and preheated by high frequency energy. At the same time, the above-mentioned impregnant alloy contained in a mother alloy melting crucible disposed under the skeleton holder is melted by high frequency energy in a vacuum. The Co skeleton is preheated to about 1000° C. and then immersed in the molten bath of the impregnating alloy after the confirmation of the complete molten state of the impregnant alloy. After the immersion for a predetermined time at a predetermined temperature, the skeleton is lifted up and subject to furnace cooling as it is. By the above-mentioned steps, an excellent impregnating alloy of 97~99% filling density can be obtained. As the result of observation of the microstructure (100 magnifications) of an impregnating alloy having the components of 70% Co-30% (84% Cu-15% Ag-1% Bi), as an example of the alloy according to the present invention, it was found that the alloy was constituted by the large gray particles and the white Cu-Ag-Bi alloyed basic portion.

Various kinds of impregnant alloys containing Co as their base were produced by the method as described above and spherical electrodes were cut out from the alloys. Each electrode was finished to a spherical surface of 20 mm diameter having a contact surface of 10 mm radius. With respect to the thus produced electrodes, various kinds of electrical properties were examined by using a vacuum switch test device with a built-up exhaust system. The result of this examination is as shown in Table 1.

| No. | Electrode Material (wt. %) | Average withstand-voltage (kV) at 2.5 mm gap | Current break-off performance (%) | Non-welding characteristic | Chopping current (A) Max. | Chopping current (A) Average |
|---|---|---|---|---|---|---|
| Invention | | | | | | |
| 1 | Co-10 (Cu—30Ag—1Bi) | 105 | 130 | ○ | 5.6 | 3.9 |
| 2 | Co-20 (Cu—30Ag—1Bi) | 95 | 135 | ○ | 5.3 | 3.7 |
| 3 | Co-30 (Cu—30Ag—1Bi) | 80 | 137 | ◎ | 5.1 | 3.5 |
| 4 | Co-40 (Cu—30Ag—1Bi) | 60 | 135 | ◎ | 5.0 | 3.5 |
| 5 | Co-60 (Cu—30Ag—1Bi) | 55 | 130 | ◎ | 4.5 | 3.1 |
| 6 | Co-30 (Cu—15Ag—0.5Bi) | 97 | 140 | ◎ | 5.5 | 3.8 |
| 7 | Co-30 (Cu—15Ag—0.5Pb) | 98 | 145 | ○ | 5.9 | 4.1 |
| 8 | Co-30 (Cu—15Ag—0.5Te) | 95 | 140 | ○ | 5.6 | 3.9 |
| 9 | Co-30 (Cu—15Ag—0.5Se) | 85 | 135 | ○ | 4.3 | 3.0 |
| 10 | Co-30 (Cu—15Ag—0.5BiPb) | 90 | 140 | ○ | 4.8 | 3.3 |
| Prior Art | | | | | | |
| 11 | Cu—1Pb | 30 | 100 | ○ | 12.0 | 8.4 |
| 12 | Cu—20Co—1BiPb | 60 | 120 | ○ | 6.5 | 4.5 |
| 13 | Cr—50Cu | 40 | 110 | ◎ | 4.5 | 3.1 |
| 14 | Co-40 (Ag—1Te) | 50 | 120 | ◎ | 3.0 | 2.1 |

In Table 1, Nos. 1~10, No. 13 and No. 14 are impregnating alloys, Nos. 1~10 are the materials according to the present invention and Nos. 11~14 are conventional materials. As will be appreciated from the result shown in Table 1, the electrode, made according to the present invention of Co-(Cu-Ag-element of low-melting-point and high-vapor-pressure) alloy, has a low chopping current property, such as a maximum value of 6A and an average value of 4.5 A, a high withstand-voltage characteristic, such as 55 kV or more, and a good current break-off performance, such as 130% or more. With respect all these properties, the materials according to the present invention are superior to the conventional Cu-alloy (Nos. 11 and 12) and conventional impregnating alloys (Nos. 13 and 14).

In the withstand-voltage/break-off test, after the electrode structure was subjected to breaking off of current of a.c. 300 A ten times, and then cleaned, the breakdown voltage was tested while applying thereto an impulse voltage which was successively stepped up by 5 kV. The electrode gap was 2.5 mm. In the chopping current test, the chopping current generated upon breaking-off of a.c. 10 A was measured 100 times and the maximum and average values thereof were obtained. The current break-off performance was measured such that a current successively stepped up by 500 A was repeatedly broken off and the maximum current value with which the electrode structure did not succeed in breaking off the current was expressed in % as the value representing the current break-off performance of the electrode in comparison with the maximum break-off current value, as shown in No. 11 of the table as 100%, measured by using the conventional electrode structure using Cu-1% Pb alloy. The surface of each of the electrodes was in good state when it broke-off a current at the maximum break-off current value, indicating a good non-welding characteristic. The materials in which a Cu-Ag-Bi alloy of 30~60 wt. % was impregnated into Co exhibited a particularly excellent non-welding characteristic. The break-off current of the material No. 11 was about 7 kA and the alloy used to the material was an impregnating alloy containing Pb in the form of particles.

Figure 1:
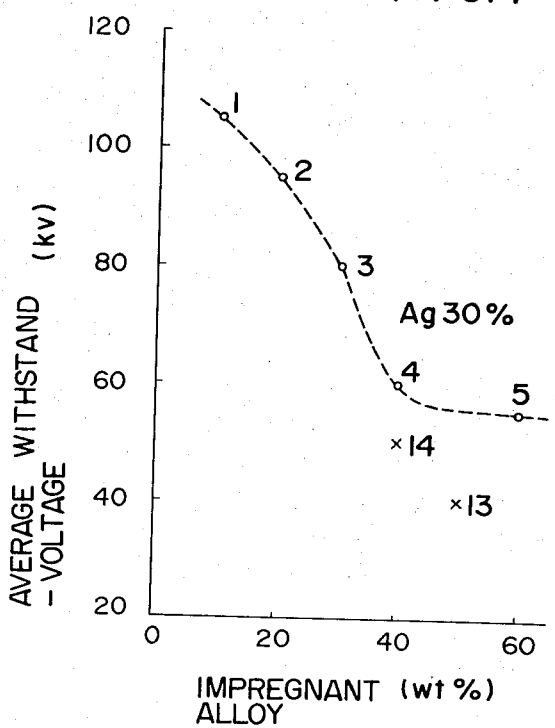
FIG. 1 is a diagram showing the relation between the average withstand-voltage and the amount of impregnation of impregnant alloy.

FIG. 1 is a diagram showing the relation between the average withstand-voltage and the amount of impregnation of the impregnating alloy containing Ag of 30 wt. %. In the drawing, the numeral represents the number of electrode material shown in Table 1. As shown in the drawing, as the content of the impregnating alloy in the Co skeleton increases the average withstand-voltage sharply drops. In view of the withstand-voltage characteristic, it is preferable to restrict the content of the impregnant alloy to 40 wt. % or less. It is apparent that the withstand-voltage characteristic of the conventional electrode material Nos. 13 and 14 is low even though the amount of impregnant is selected to be the same as those according to the present invention.

FIG. 2 is a diagram showing the relation between the current break-off performance and the amount of impregnation of impregnating alloy containing Ag of 30 wt. %. As seen from the drawing, it is apparent that the electrode material is remarkably superior in current break-off performance to the conventional electrode materials Nos. 13 and 14 even though the amount of impregnant is selected to be the same as those according to the present invention. Particularly, the current break-off performance of 130% or more can be obtained with the amount of impregnant of 10~60 wt. %.

Figure 3:
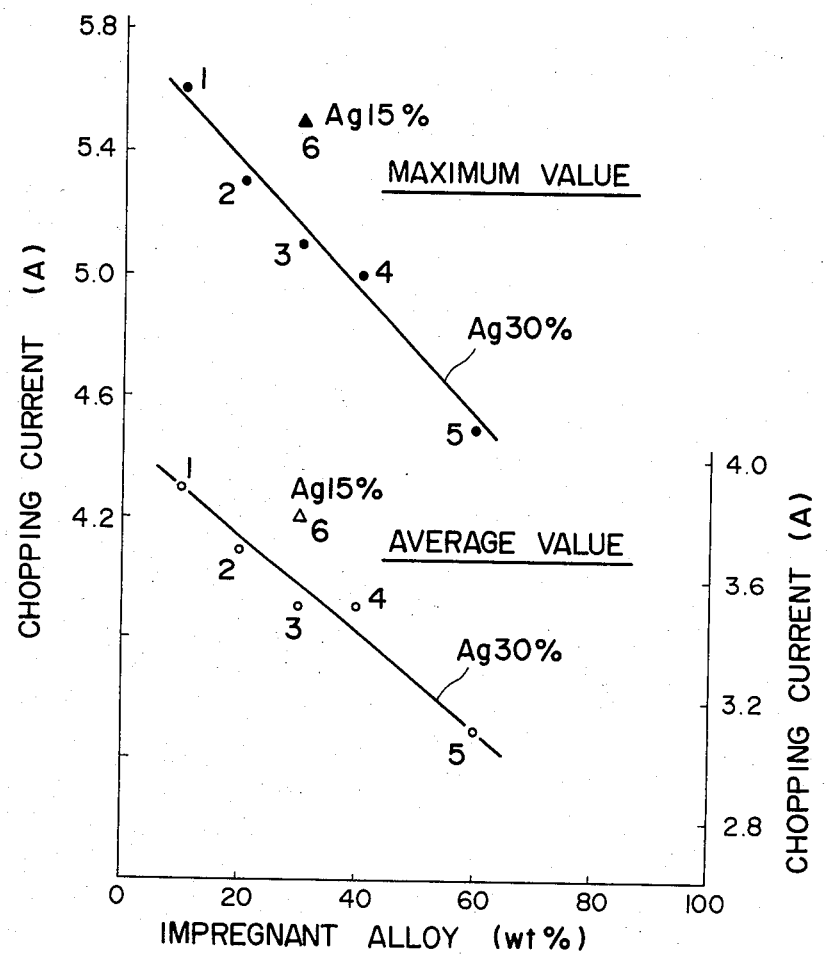
FIG. 3 is a diagram showing the relation between the chopping current and the amount of impregnation of the impregnant alloy.

FIG. 3 is a diagram showing the relation between the chopping current and the amount of impregnation of impregnating alloy containing Ag of 30 wt. %. With the electrode materials according to the present invention, it is apparent that the maximum chopping current is 6 A or less and the average chopping current is 4.5 A or less even in the case where the amount of impregnant is the order of 10 wt. %.

Figure 4:
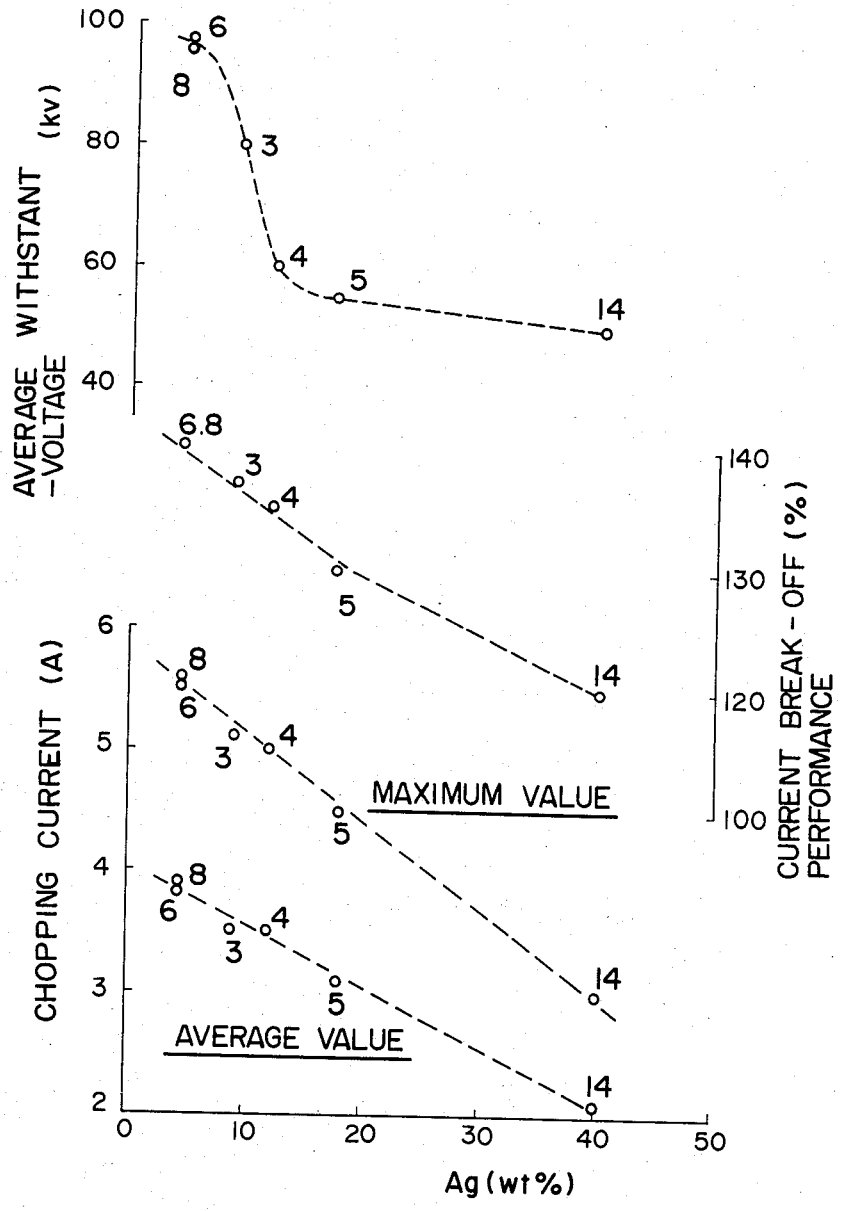
FIG. 4 is a diagram showing the relation between the content of Ag in the entire electrode and each of the average withstand-voltage and the chopping current.

FIG. 4 is a diagram showing the relation among the content of Ag in the impregnant alloy of the amount of which in the entire electrode is 30~60 wt. %, the average withstand-voltage, the current break-off perofrmance, and the chopping current. The amount of Ag significantly affects these properties. As shown in the drawing, Ag may remarkably deteriorate the withstand-voltage characteristic. Particularly, in order to make the withstand-voltage 55 kV or more, it is necessary to select the content of Ag to 12 wt. % or less. The current break-off performance may be remarkably lowered depending on the content of Ag. In order to obtain the current break-off performance of 130%, it is necessary to restrict the content of Ag to 12 wt. % or less. The chopping current drops sharply as the content of Ag increases.

EXAMPLE 2

Figure 5:
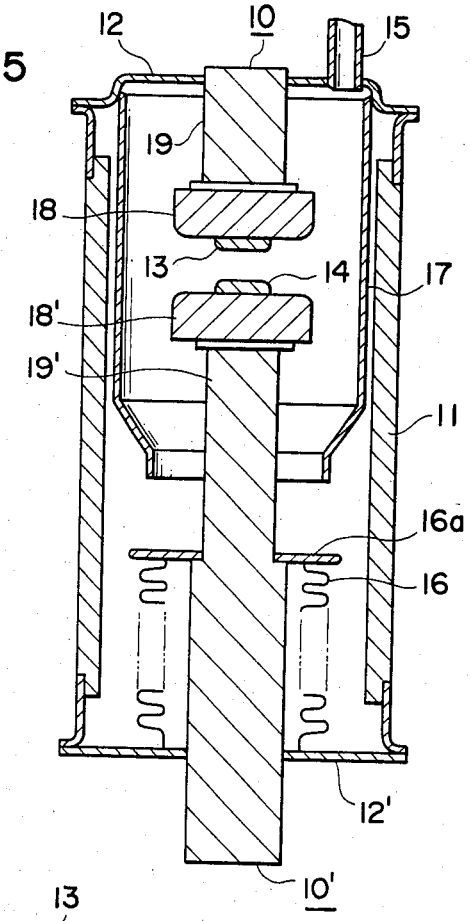
FIG. 5 is a cross-section showing the structure of an example of a vacuum switch.

The electrode using the material according to the present invention is disposed in a vacuum tube of a vacuum switch as shown in FIG. 5. The vacuum tube includes an insulator cylinder 11 which is made of a ceramic or cristallized material and the-opposite ends of which are sealed by metal end plates 12 and 12'. The tube is arranged to maintain its inner pressure at $1\times10^{-5}$ mmHg As a pair of electrodes, a fixed electrode 10 and a movable electrode 10' which is arranged to be movable to perform the ON/OFF operation through a bellows 16 are incorporated in the tube. An exhaust pipe 15 is attached at its one end to the end plate 12 and connected at the other end to a vacuum pump (not shown) so that after the bulb has been exhausted of the air to a predetermined inner pressure the pipe is tipped off at a given portion thereof. A cylindrical shield 17 arranged to surround the electrodes serves to receive the spattering materials from the electrodes when the electrode material is vaporized and spattered in current breaking-off to prevent the spattering material from being applied to other portions. The fixed and movable electrodes 10 and 10' are respectively provided with contact electrodes 13 and 14 which are respectively connected to auxiliary electrode members 18 and 18' made of Cu and Cu-alloy. The material as shown in EXAMPLE 1, for example a 70/40 wt. % Co-30/60 wt. % (82.75 wt. % Cu-17 wt. % Ag-0.25 wt. % Bi) alloy, is soldered to each of the contact electrodes 13 and 14 and holders 19 and 19' made of Cu are attached to the materials. Each of the contact electrodes is constituted by the material, similar to that described in EXAMPLE 1, which is made such that a Cu-Ag-Bi alloy is impregnated into a Co-skeleton. A part of Co of the skeleton was solved and about 3 wt. % of the same was contained in the impregnating alloy after the impregnation. The content of Bi was 0.075~0.15 wt. %, respectively, with respect to the whole electrode contact.

Figure 6:
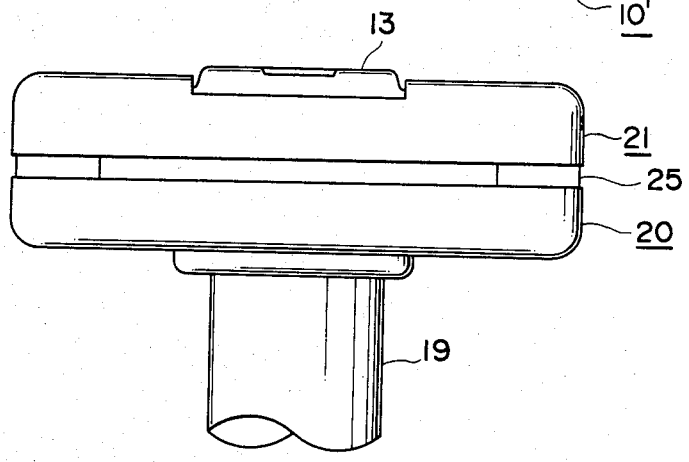
FIG. 6 is a front view of an example of an electrode for the vacuum switch according to the present invention.
Figure 7:
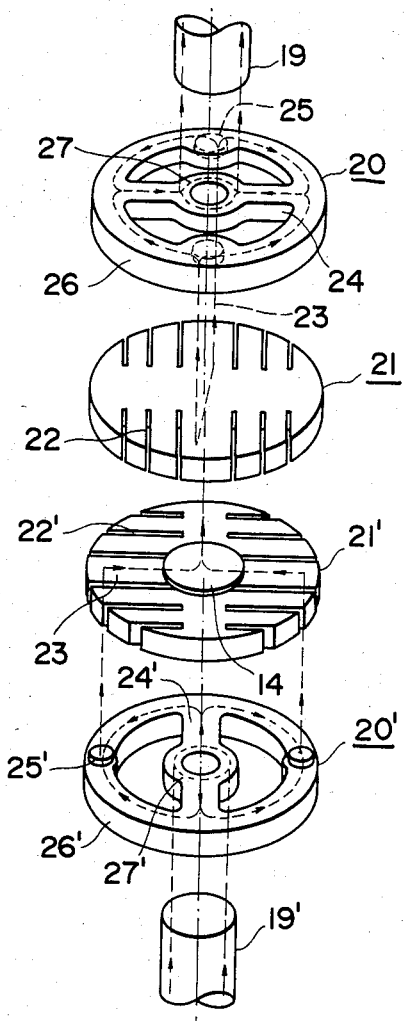
FIG. 7 is a exploded perspective view of an example of an electrode for the vacuum switch according to the present invention.

FIG. 6 shows the detail of the configuration of the electrode 10 and FIG. 7 is an exploded perspective view of the electrodes 10 and 10'. The electrodes 10 and 10' have the same structure with each other. The contact electrodes 13 and 14 are respectively connected to arc drive electrodes 21 and 21'. Eddy current suppressing grooves 22 and 22' are respectively formed in the arc drive electrodes 21 and 21' so that arc currents 23 may flow as shown in FIG. 7. A (Cu-20 wt. % Co-3 wt. % Ag) alloy is used for each of the axiliary electrodes 21 and 21'. Coil electrodes 20 and 20' are respectively constituted by ring portions 26 and 26', arm portions 24 and 24', axis center portions 27 and 27', connection portions 25 and 25' symmetrically provided on the respective ring electrodes 26 and 26' for connecting the ring electrodes 26 and 26' to the respective arc drive electrodes 21 and 21'. Pure copper having high conductivity is used for the coil electrodes 20 and 20'. Holders 19 and 19' are respectively connected to the coil electrodes 20 and 20' at the respective axis center portions 27 and 27'. These holders 19 and 19' are made of pure copper similarly to the coil electrodes 20 and 20'. As shown in FIG. 6, the contact electrodes 13 and 14 are embedded respectively into the arc drive electrodes 21 and 21' and fixedly connected thereto. The electrodes are arranged such that a parallel magnetic field is induced at an air gap between the electrodes to thereby allow arcs to be generated at the entire surfaces of both the contact electrodes 13 and 14 and the arc drive electrodes 21 and 21' in current breaking-off. As shown in FIG. 7, the electrodes 10 and 10' are disposed such that they are circumferentially shifted 90° from each other. That is, in the arc drive electrodes 21 and 21', the arc suppressing grooves 22 and 22' are circumferentially shifted by 90° from each other and in the coil electrodes 20 and 20', the arm portions 24 and 24' are disposed perpendicularly to each other. In this arrangement, the direction of the magnetic field in the ranges 0°~90° and 180°~270° and the direction of the magnetic field in the,ranges 90°~180° and 270°~360° are completely in opposition to each other so that the magnetic field becomes a parallel one. By the generation of such a parallel magnetic field, the arcs are controlled to be generated at the entire surfaces of the contact electrodes and the arc drive electrodes, in current break-off.

It was found that a large break-off performance, a high withstand-voltage characteristic and an excellent non-welding characteristic could be obtained when a short-circuit current at the rating of 12 kV and 50 kA with a vacuum tube having the structure as described above. The chopping current was so small to be 3~5 A when it was generated upon cutting-off of a small current of 2~6 A in the 12 kV circuit and it was found that the structure was provided with a low surge property as in the conventional one.

We claim:

1. A vacuum switch comprising a vacuum container and a pair of contact electrodes, in which at least one of said contact electrodes is constituted by a skeleton containing cobalt as its principal component and having air gaps into which an alloy containing copper, silver, and a low melting point and high vapor pressure element having substantially no or very low solid-solubility with respect to the copper at room temperature is impregnated.

2. A vacuum switch according to claim 1, in which said alloy is impregnated in an amount of 10~60 weight % of the total weight of said at least one contact electrode.

3. A vacuum switch according to claim 1, in which said low melting point and high vapor pressure element contains at least one selected from the group of bismuth, lead, tellurium, selenium, and thallium.

4. A vacuum switch according to claim 1, in which said low melting point and high vapor pressure element is bismuth.

5. A vacuum switch according to claim 1, in which said contact electrodes are respectively connected to electrically conductive auxiliary electrode members which are in turn connected respectively to electrode holders supported by said container.

6. A vacuum switch comprising a vacuum container and a pair of contact electrodes, in which each of said contact electrodes is constituted by a skeleton made of cobalt powder, to provide a porous skeleton, into which a copper alloy is impregnated, and each of said contact electrodes contains silver of 2~20 weight %, a low melting point and high vapor pressure element of 0.05~1 weight %, cobalt of 30~60 weight % and copper occupying substantially the remainder part, said cobalt powder having a particle diameter of 10~50 μm.

7. A vacuum switch comprising a vacuum container and a pair of contact electrodes, in which each of said contact electrodes is constituted by a skelton made substantially of cobalt, said skeleton having pores, and an alloy impregnated in said pores in an amount of 10~60 weight % of the entire weight of the contact electrode, said alloy containing silver of 10~50 weight %, at least one selected from the group of bismuth, lead, tellurium and selenium by 0.1~3 weight %, and copper occupying substantially the remainder part.

8. A vacuum switch comprising a vacuum container and a pair of contact electrodes, in which each of said contact electrodes is constituted by a skeleton made substantially of cobalt and having pores, with an impregnant of an alloy impregnated in said pores in an amount of 10~50 weight % of the entire weight of said electrode contact, said copper alloy containing silver of 10~50 weight %, at least one selected from the group of bismuth, lead, tellurim and selenium by 0.1~3 weight % cobalt of 5 weight % or less, and copper occupying substantially the remainder part.

9. A vacuum switch comprising a vacuum container and a pair of electrode structures, in which said electrode structures respectively includes contact electrodes, arc drive electrodes respectively supporting said contact electrodes, and coil electrodes respectively supporting said arc drive electrodes, said arc drive electrodes and said coil electrodes being arranged such that a parallel magnetic field is induced at an air gap between said contact electrodes, and in which at least one of said contact electrodes is constituted by a skeleton containing cobalt as its principal component and having pores, said pores being impregnated with an impregnant containing Ag in an amount of 10~50 weight % based on the total weight of the impregnant, a low melting point and high vapor pressure element having substantially no or very low solid-solubility with respect to copper at room temperature, in an amount of 0.1~3 weight % based on the total weight of the impregnant, and a remainder part substantially composed of Cu.

10. A vacuum circuit breaker according to claim 9, in which each of said arc drive electrodes is made of a solidified molten alloy containing cobalt of 10~30 weight %, silver of 10 weight % or less, and copper occupying substantially the remainder part.

11. A vacuum switch according to claim 9, in which each of said coil electrodes is made of copper.

12. A vacuum switch according to claim 9, in which each of said arc drive electrodes is provided with a plurality of bisymmetrically and equidistantly formed grooves for suppressing eddy currents.

13. A vacuum switch according to claim 9, in which each of said coil electrodes is constituted by an annular ring portion, an arm portion passing through the axis center of circle of said ring portion, and a connecting portion including protrusion portions for connecting said coil electrode to corresponding one of said arc drive electrodes.

14. A vacuum switch comprising a vacuum container and a pair of electrode structures: in which said electrode structures respectively include contact electrodes, arc drive electrodes respectively supporting said contact electrodes, coil electrodes respectively supporting said arc drive electrodes, and holders respectively supporting said coil electrodes; in which each of said arc drive electrodes is provided with a plurality of equidistantly formed grooves, formed into a bisymmetrical shape, and consituted by an alloy containing cobalt of 10~30 weight %, silver of 10 weight % or less, and copper occupying substantially the remainder part; in which each of said contact electrodes is constituted by a skeleton, made substantially of cobalt, with pores, said pores being impregnated with an impregnant in an amount of 10~60 weight % of the entire weight of said contact electrode, said impregnant containing silver in an amount of 10~50 weight %, at least one selected from the group of bismuth, lead, tellurium and selenium in an amount of 0.1~3 weight %, and copper occupying substantially the remainder part; in which each of said coil electrodes is made of copper and constituted by an annular ring portion, an arm portion passing through the axis center of circle of said ring portion, and a connecting portion including protrusion portions for connecting said coil electrode to corresponding one of said arc drive electrodes; and in which the extending directions of said grooves in one of said arc drive electrodes and that of said grooves in the other arc drive electrode perpendicularly cross each other and the extending directions of said arms of said respective coil electrodes also perpendicularly cross each other so that a parallel magnetic field is induced at an air gap between said contact electrodes.

15. A vacuum circuit breaker comprising a vacuum container and a pair of contact electrodes, in which at least one of said contact electrodes is constituted by a skeleton containing cobalt as its principal component and having pores, said pores being impregnated with an impregnant of a Cu-Ag alloy.

16. A vacuum switch comprising a vacuum container and a pair of contact electrodes, in which at least one of said contact electrodes is constituted by a metal material which has properties that a chopping current is 6 A at maximum and 4.5 A or less in average with a current of 10 A, an average withstand-voltage is 55 kV or more at a 2.5 mm air gap, and a break-off current by a spherical surface having a diameter of 20 mm and a radius of 10 mm of 9 kA or more.

17. A method of manufacturing a vacuum switch having a container and a pair of contact electrodes, comprising the steps of:

(a) molding powder containing cobalt into a porous skeleton having air gaps;

(b) immersing said skeleton in a molten bath of an alloy containing silver in an amount of 10~50 weight % based on the total weight of the alloy, a low melting point and high vapor pressure element having substantially no or very low solid-solubility with respect to copper at a room temperature, in an amount of 0.1~3.0 weight % based on the total weight of the alloy, with copper being substantially the remainder of said alloy, so that said molten alloy is impregnated into said air gaps; and (c) shaping the material including said skeleton in which said alloy has been impregnated, into a predetermined shape and disposing on a surface to form said contact electrodes.

18. A method of manufacturing a vacuum switch having a container and a pair of contact electrodes, comprising the steps of:

(a) molding powder containing cobalt into a porous skeleton having pores and heating said skeleton in a vacuum;

(b) immersing said skeleton, in a vacuum, into a molten bath of alloy containing silver in an amount of 10~50 weight % based on the weight of the alloy, a low melting point and high vapor pressure element having substantially no or very low solid-solubility with respect to copper at room temperature, in an amount of 0.1~3 weight % based on the weight of the alloy, and copper being substantially the remainder of the alloy, so that said molten alloy is impregnated into said pores; and (c) shaping the material including said skeleton in which said alloy has been impregnated, into a predetermined shape and disposing on a surface to form said contact electrodes.

19. A vacuum switch according to claim 1, wherein said skeleton consists essentially of Co.

20. A vacuum switch according to claim 19, wherein said alloy is impregnated in said skeleton in amount of 10~60 weight % of the total weight of the at least one electrode.

21. A vacuum switch according to claim 1, wherein the skeleton is impregnated with the alloy in an amount of 30~60 weight % of the total weight of said at least one contact electrode.

22. A vacuum switch according to claim 1, wherein the alloy contains silver in a sufficient amount such that the quantity of silver in the at least one contact electrode is 2~20 weight % based on the total weight of said at least one contact electrode.

23. A vacuum switch according to claim 1, wherein the alloy contains said low melting point and high vapor pressure element in such an amount that the at least one contact electrode contains said element in an amount of 0.05~1.0 weight % based on the total weight of the at least one contact electrode.

24. A vacuum switch according to claim 1, wherein said alloy is a copper alloy, containing copper as its principal component.

25. A method according to claim 17, wherein the cobalt powder each have a particle diameter of 30~70 μm.

* * * * *